US007083354B2

(12) United States Patent
Byun

(10) Patent No.: US 7,083,354 B2
(45) Date of Patent: Aug. 1, 2006

(54) COSMETICS CASE HAVING RECEIPT DRAWING TOILET SET

(76) Inventor: Young-Kwang Byun, 928-1005, Mok-Dong APT, 312, Shinjeong-Dong, Yangcheon-Ku, Seoul 158-769 (KR)

( * ) Notice: Subject to any disclaimer, the term of this patent is extended or adjusted under 35 U.S.C. 154(b) by 223 days.

(21) Appl. No.: 10/671,563

(22) Filed: Sep. 29, 2003

(65) Prior Publication Data

US 2004/0222124 A1 Nov. 11, 2004

(30) Foreign Application Priority Data

May 7, 2003 (KR) ..... 10-2003-0028903

(51) Int. Cl.
*A47L 13/30* (2006.01)
*A46B 11/00* (2006.01)

(52) U.S. Cl. ..... 401/263; 401/125; 401/123; 401/126; 132/297; 132/294; 132/317

(58) Field of Classification Search ..... 401/123–129; 132/293–297, 313, 314, 317
See application file for complete search history.

(56) References Cited

U.S. PATENT DOCUMENTS 958,480 A * 5/1910 Dreher ..... 401/125
1,782,024 A * 11/1930 Aronson ..... 132/297
1,961,437 A * 6/1934 Tuttle et al. ..... 401/123
2,547,971 A * 4/1951 Polin et al. ..... 132/297
4,228,925 A * 10/1980 Mendelovich ..... 401/125
4,726,387 A * 2/1988 Sarica ..... 401/123
5,107,984 A * 4/1992 Welschoff ..... 132/297
5,301,808 A * 4/1994 Pierson ..... 132/297
6,298,863 B1 * 10/2001 Byun ..... 401/125

* cited by examiner

*Primary Examiner*—Khoa D. Huynh
(74) *Attorney, Agent, or Firm*—Birch Stewart Kolasch & Birch LLP

(57) ABSTRACT

A cosmetic case 1 having receipt function of toilet set comprising a case body 10 having a receipt part 11 to receive cosmetics 11*a* and a case cover 20 to close/open top portion of the case body 10, characterized in that a receipt space 12 is formed on bottom portion of the case body 10 to carry a toilet set 30; the toilet set 30 having a hook threshold 32 at upper portion of one end thereof to allow the toilet set 30 capable of being received into and/or pulled out of the receipt space 12 by the case cover 20 when the case cover 20 is assembled with and/or disassembled from the case body 10. The cosmetics case 1 can easily include the toilet set 30, provide convenience to consumers, as well as achieving improvement of performance and high-quality appearance of the case 1.

1 Claim, 3 Drawing Sheets

COSMETICS CASE HAVING RECEIPT DRAWING TOILET SET

BACKGROUND OF THE INVENTION

1. Field of the Invention

The present invention relates to a cosmetics case having receipt function of toilet set, more particularly, comprising a case body having a receipt space to carry the toilet set and a case cover; the toilet set having a hook threshold at upper portion of one end of the toilet set to contact and/or to be separated from inner side of lower end of the case cover when the case cover is assembled with and/or disassembled from the case body, whereby the toilet set is able to be received into and/or pulled out of the receipt space. The cosmetics case according to the present invention can easily carry the toilet set, provide convenience to consumers, and achieve improvement of performance and high-quality appearance of the case.

2. Description of the Related Art

Various designs and/or structures of cosmetics cases are conventionally and commercially used in related applications. Such cases generally have circular or rectangular forms and most of them is consisted of a body and a cover hinged to the body at one side of the cover to be opened/closed on the hinge axis or has a cylindrical structure of the body and the cover coupled together by means of screw-thread.

However, such cosmetics case has originally a receipt part to receive cosmetics and to store toilet set inside the case, which causes inconvenience to use and retain the toilet set and often misses or damages the toilet set.

SUMMARY OF THE INVENTION

It is, therefore, an object of the present invention is to solve the problem mentioned above, in particular, to provide a cosmetics case having receipt function of toilet set comprising a case body having a receipt space to carry the toilet set at bottom portion of the body and a case cover; the toilet set having a hook threshold at upper portion of one end of the toilet set to contact and/or to be separated from inner side of lower end of the case cover when the case cover is assembled with and/or disassembled from the case body, whereby the toilet set is able to be received into and/or pulled out of the receipt space. The cosmetics case according to the present invention can easily carry the toilet set, provide convenience to consumers, and achieve improvement of performance and high-quality appearance of the case.

BRIEF DESCRIPTION OF THE DRAWINGS

The above object, features and advantages of the present invention will become more apparent to those skilled in the related art from the following detailed description for preferred embodiments taken in conjunction with the accompanying drawing, in which.

DETAILED DESCRIPTION OF THE PREFERRED EMBODIMENT

The present invention will be described in more detail be reference to the following embodiments which are presented for purpose of illustration and should not be construed to limit the scope of the invention thereto.

Firstly, a first embodiment according to the present invention is described as follows with reference to the accompanying drawings.

Figure 1:
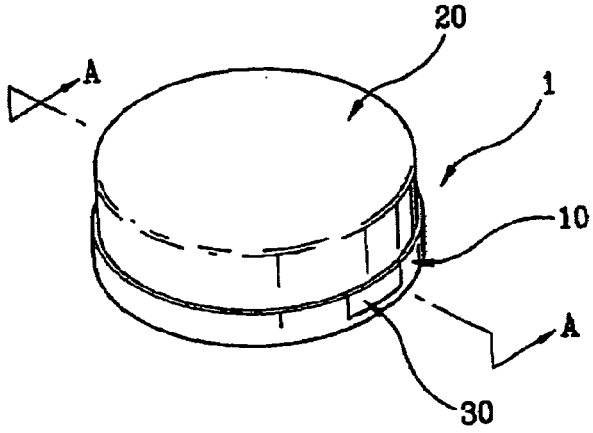
FIG. 1 is a perspective view of a first embodiment according to the present invention.
Figure 2:
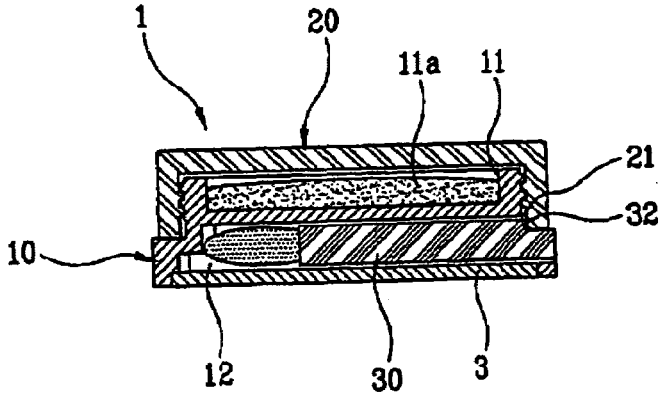
FIG. 2 is a cross-sectional view of the first embodiment taken along the line A—A of FIG. 1.
Figure 3:
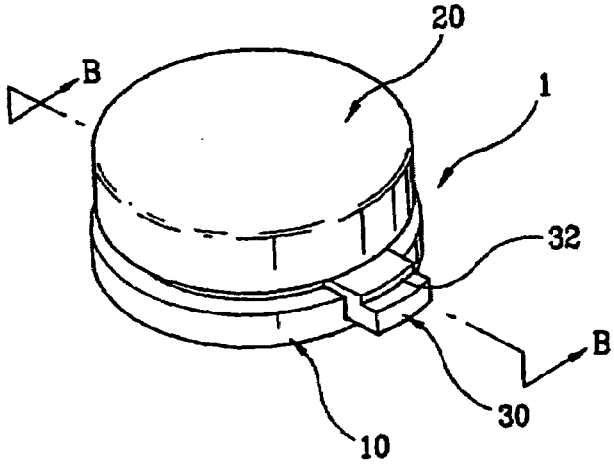
FIG. 3 is another perspective view of the first embodiment according to the present invention, showing the toilet set partially protruded by opening a bit the case cover.
Figure 4:
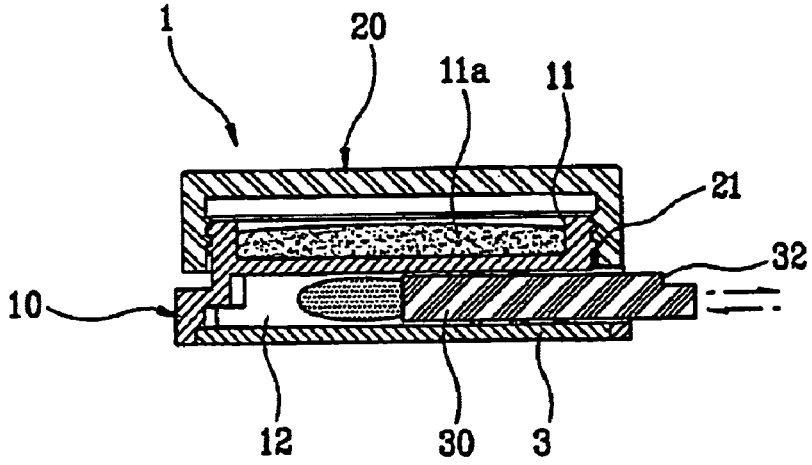
FIG. 4 is another cross-sectional view taken along the line B—B of FIG. 3.
Figure 5:
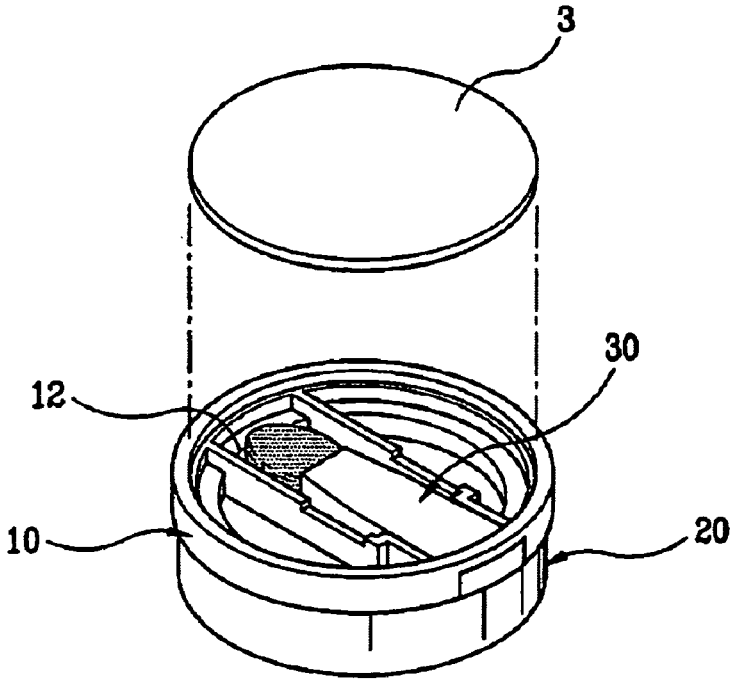
FIG. 5 is another perspective view of the first embodiment according to the present invention, showing the inside of a bottom portion of the case body by removing the plugging panel mounted on the bottom portion.

FIG. 1 illustrates a perspective view of the first embodiment, FIG. 2 shows a cross-sectional view taken along the line A—A of FIG. 1, FIG. 3 is another perspective view of the first embodiment showing the toilet set partially protruded from the case by opening a bit the case cover, FIG. 4 shows a cross-sectional view taken along the line B—B of FIG. 3, and FIG. 5 is a bottom side perspective view of the first embodiment showing the inside of the bottom portion of the case body by removing the plugging panel mounted on the bottom portion of the case body.

The cosmetics case 1 according to the present invention comprises a case body 10 having a receipt part 11 to receive cosmetics 11*a* and a case cover 20 to close/open top portion of the case body 10, characterized in that:

a receipt space 12 is formed on bottom portion of the case body 10 to carry a toilet set 30; the toilet set 30 having a hook threshold 32 at upper portion of one end of the toilet set to contact and/or to be separated from inner side 21 of lower end of the case cover 20 when the case cover 20 is assembled with and/or disassembled from the case body by means of screw-thread manner, whereby the toilet set 30 is able to be received into and/or pulled out of the receipt space 12.

More particularly, by forming a receipt space 12 within bottom portion of the case body 10 in a desired volume to receive a small toilet set 30 such as cosmetic brush and forming stepwise a hook threshold 32 at one end of said toilet set 30, the cosmetics case 1 can carry the toilet set 30 when closing the case cover 20 having inner side 21 of its lower end to push the hook threshold 32 inside the case body 20 and, if the case cover 20 is opened, the hook threshold 32 is free thus the toilet set 30 can be escaped out of the case 1.

Practical use of the first embodiment with such construction described above will be illustrated as follows:

As shown in FIG. 1 to 5, the cosmetics 11*a* and the toilet set 30 are together included in the case body 10. If turning round the locked case cover 20 by 2~3 revolutions in a direction of unfastening the cover 20, the case cover 20 is apart from the case body 10 in a constant interval. Then, the hook threshold 32 of the toilet set 30 hooked on the inner side 21 of lower end of the case cover 20 is released out of the cover 20 thus induce the toilet set 30 placed in the receipt space 12 to a condition to be escaped out of the case 1, therefore, capable of being used by simply drawing the toilet set 30 out of the case 1.

In the other way, in order to put the toilet set 30 into the receipt space 12 after completion of using it, the toilet set 30 is firstly forced into the space 12 then the case cover 20 is screw-coupled to the case body 10, through a process that the inner side 21 of lower end of the case cover 20 pushes down and secures the hook threshold 32 at one end of the toilet set 30 to induce the latter to be received into the receipt space 12, thereby allowing the toilet set 30 to be carried with the cosmetics case 1.

In drawings, the numeral 3 not described herein means a plugging panel mounted on bottom portion of the case body 10.

Figure 6:
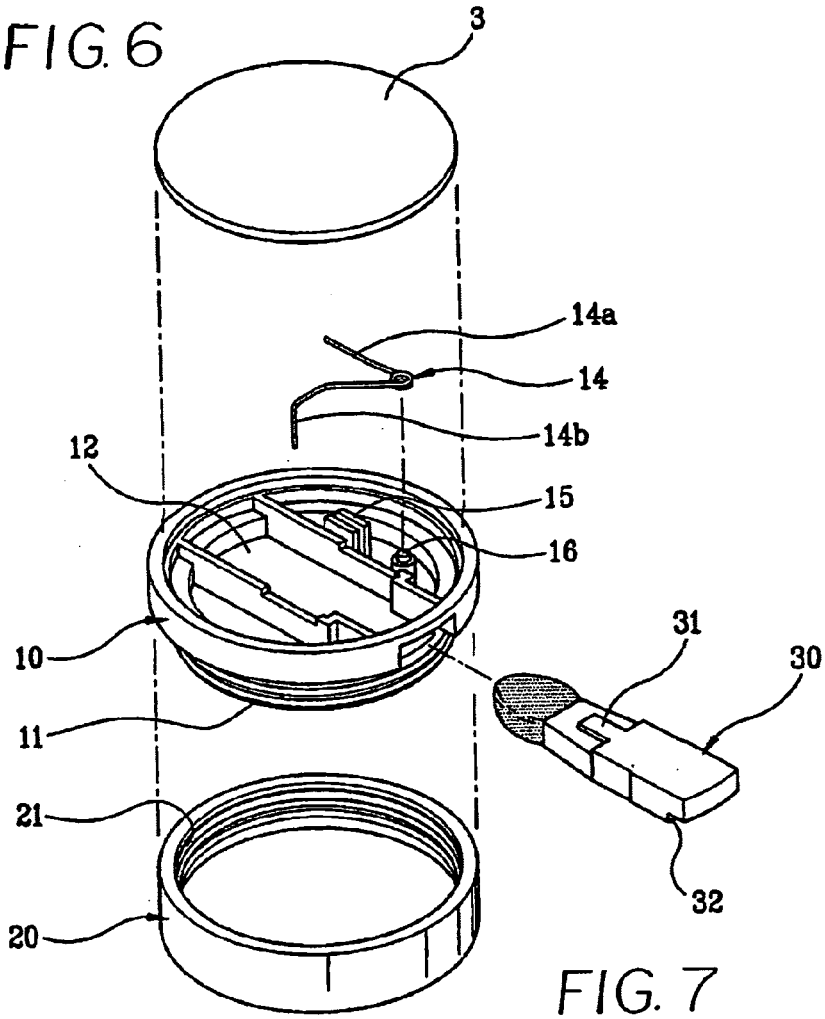
FIG. 6 is an exploded perspective view of a second embodiment according to the present invention, showing reverse side of the cosmetics case.
Figure 7:
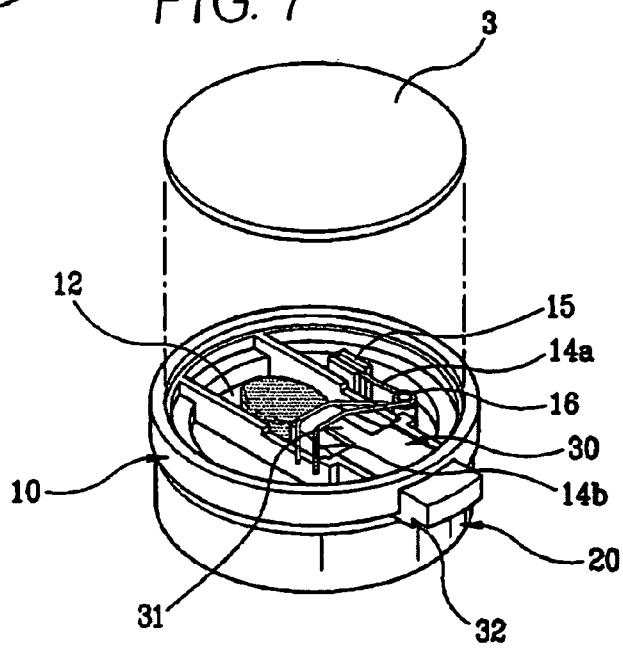
FIG. 7 is a bottom-side perspective view of the second embodiment according to the present invention, showing the toilet set partially protruded by removing the plugging panel mounted on the bottom portion of the case body and partially opening the case cover.

FIG. 6 and FIG. 7 illustrate a second embodiment of the present invention which further has a spring 14 to easily draw the toilet set 30 out of the case body 10, in addition to the first embodiment.

Particularly, the second embodiment comprises a fixed rod 16 as a fixed axis of the spring 14 and a fixation piece 15 to secure one end 14*a* of the spring 14, both being mounted near one side of the receipt space 12, and a pushing threshold 31 formed on rear portion of lower side (shown as upper side in FIGS. 5 and 6) of the toilet set 30.

Center portion of such spring 14 is fitted into the fixed rod 16 and the one end 14*a* is inserted and positioned between the fixation piece 15, and another end 14*b* of the spring 14 contacts and is assembled to the pushing threshold 31 of the toilet set 30.

Accordingly, when an user of the cosmetics 11*a* turns round the case cover 20 by 2~3 revolutions in the opening direction, the case cover 20 pressing the hook threshold 32 same as the first embodiment is released from the hook threshold 32 and the toilet set 30 becomes protruded by elastic force of the spring 14, thus providing a benefit of convenience for using the toilet set 30 than the first embodiment in its technical construction.

When placing the toilet set 30 into the receipt space 12 after completion of using it, the toilet set 30 can be perfectly received in the receipt space 12 by fully screw-coupling the case cover 20 to the case body 10 under a status of pushing the toilet set 30 into the receipt space 12 then pressing it to lead the hook threshold 32 of the toilet set 30 to be hooked to the inner side 21 of lower end of the case cover 20.

INDUSTRIAL APPLICABILITY

As clearly described above, the cosmetics case according to the present invention which comprises the case body having a receipt space to carry toilet set at bottom portion of the case body and a case cover, the toilet set being drawn out of the receipt space by opening the case cover, can easily store the toilet set 30, provide convenience to consumers, as well as achieving improvement of performance and high-quality appearance of the cosmetics case.

What is claimed is:

1. A cosmetic case (1) having receipt function of toilet set comprising a case body (10) having a receipt part (11) formed on a top portion of the cosmetic case to receive cosmetics (11*a*) and a case cover (20) removably connected to the top portion of the case body (10); a receipt space (12) is formed on a bottom portion and located directly beneath said receipt part (11) of the case body (10) to slidably receive and to carry a toilet set (30), said toilet set having an upper side and opposite lower side; and the toilet set (30) has a cosmetic applicator head at a first end and a stepwise hook threshold (32) formed at an upper portion of said upper side of an opposite second end of the toilet set, said stepwise hook threshold hooked to an inner side (21) of a lower end of the case cover (20) when the case cover (20) is rotated into a closed position with the case body, whereby the toilet set (30) is coupled and secured into the receipt space (12), wherein a pushing threshold (31) is formed on a rear portion of said opposite lower side of the toilet set (30), one end (14*b*) of a spring (14) contacting the pushing threshold (31) to allow the toilet set (30) to be drawn out of the case body by the elastic force of the spring (14) when the case cover is rotated into an open position with said inner side (21) disengaging said stepwise hook threshold.

* * * * *